US010808505B2

(12) United States Patent
Chin et al.

(10) Patent No.: US 10,808,505 B2
(45) **Date of Patent: *Oct. 20, 2020**

(54) HIGH SIGNAL STRENGTH MUD SIREN FOR MWD TELEMETRY

(71) Applicant: Prime Downhole Manufacturing LLC, Houston, TX (US)

(72) Inventors: Wilson Chun-Ling Chin, Sugarland, TX (US); Kamil Iftikhar, Sugarland, TX (US)

(73) Assignee: PRIME DOWNHOLE MANUFACTURING LLC, Houston, TX (US)

( * ) Notice: Subject to any disclaimer, the term of this patent is extended or adjusted under 35 U.S.C. 154(b) by 85 days.

This patent is subject to a terminal disclaimer.

(21) Appl. No.: 16/221,735

(22) Filed: Dec. 17, 2018

(65) Prior Publication Data

US 2019/0234183 A1 Aug. 1, 2019

Related U.S. Application Data

(63) Continuation of application No. 14/995,199, filed on Jan. 14, 2016, now Pat. No. 10,156,127.

(60) Provisional application No. 62/103,421, filed on Jan. 14, 2015.

(51) Int. Cl.

| | |
|---|---|
| ***E21B 47/18*** | (2012.01) |
| ***E21B 41/00*** | (2006.01) |
| ***E21B 47/20*** | (2012.01) |

(52) U.S. Cl.

CPC ..... *E21B 41/0092* (2013.01); *E21B 47/18* (2013.01); *E21B 47/20* (2020.05)

(58) Field of Classification Search

CPC ..... E21B 47/18; E21B 47/182; E21B 47/185; E21B 47/187

See application file for complete search history.

(56) References Cited

U.S. PATENT DOCUMENTS

| | | | |
|---|---|---|---|
| 4,847,815 | A | 7/1989 | Malone |
| 5,583,827 | A | 12/1996 | Chin |
| 5,636,178 | A | 6/1997 | Ritter |
| 5,740,126 | A | 4/1998 | Chin et al. |

(Continued)

FOREIGN PATENT DOCUMENTS

| | | |
|---|---|---|
| CN | 1721655 | 12/2011 |
| CN | 203452776 | 2/2014 |

(Continued)

OTHER PUBLICATIONS

Russian Office Action issued in application No. RU 2017123961/03(041534), dated Apr. 25, 2019, 9 pages including translation, Patent Office of the Russian Federation, Federal Institute of Industrial Property.

(Continued)

*Primary Examiner* — Kenneth L Thompson
(74) *Attorney, Agent, or Firm* — King & Spalding LLP

(57) ABSTRACT

A measurement while drilling (MWD) tool includes a sensor, an encoder operably connected to the sensor and a modulator operably connected to the encoder. The modulator includes a first stator, a rotor and a second stator. The rotor is optimally positioned between the first and second stator. The use of a second stator amplifies the pressure pulse signal produced by the modulator.

17 Claims, 2 Drawing Sheets

(56) References Cited

U.S. PATENT DOCUMENTS

| | | | | |
|---|---|---|---|---|
| 6,019,182 | A | 2/2000 | Rountree et al. | |
| 7,230,880 | B2 | 6/2007 | Lehr | |
| 8,485,264 | B2 | 7/2013 | Hutin et al. | |
| 9,316,072 | B2 | 4/2016 | Rogers et al. | |
| 9,695,637 | B2 * | 7/2017 | Valliyappan | F03B 13/02 |
| 10,156,127 | B2 * | 12/2018 | Chin | E21B 47/182 |
| 2010/0230113 | A1 | 9/2010 | Hutin et al. | |
| 2013/0250728 | A1 * | 9/2013 | Burgess | E21B 47/187 367/84 |

FOREIGN PATENT DOCUMENTS

| | | |
|---|---|---|
| CN | 103790527 | 2/2017 |
| EP | 2230379 | 9/2010 |
| RU | 2256794 | 7/2005 |
| RU | 2372481 | 11/2009 |
| WO | WO 2013074070 | 5/2013 |

OTHER PUBLICATIONS

Russian Search Report issued in application No. RU 2017123961/03(041534), dated Apr. 25, 2019, 4 pages including translation, Federal Service for Intellectual Property, (ROSPATENT), Federal Institute of Industrial Property (FIPS).

International Search Report and Written Opinion issued in connection with corresponding PCT Application No. PCT/IB2016/000072 dated Jun. 2, 2016, 12 pages.

Chinese Office Action issued in patent application No. 201680005967.6, dated Mar. 12, 2020, 12 pages including translation.

* cited by examiner

HIGH SIGNAL STRENGTH MUD SIREN FOR MWD TELEMETRY

RELATED APPLICATIONS

This application is a continuation of U.S. patent application Ser. No. 14/995,199, entitled "High Signal Strength Mud Siren for MWD Telemetry," filed Jan. 14, 2014, which itself claims the benefit of U.S. Provisional Patent Application Ser. No. 62/103,421, filed Jan. 14, 2015 and entitled "High Signal Strength Mud Siren for MWD Telemetry," the disclosures of which are herein incorporated by reference.

FIELD OF THE INVENTION

This invention relates generally to the field of telemetry systems, and more particularly, but not by way of limitation, to acoustic signal generators used in wellbore drilling operations.

BACKGROUND

Wells are often drilled for the production of petroleum fluids from subterranean reservoirs. In many cases, a drill bit is connected to a drill string and rotated by a surface-based drilling rig. Drilling mud is circulated through the drill string to cool the bit as it cuts through the subterranean rock formations and to carry cuttings out of the wellbore. The use of rotary drill bits and drilling mud is well known in the art.

As drilling technologies have improved, "measurement while drilling" techniques have been enabled that allow the driller to accurately identify the location of the drill string and bit and the conditions in the wellbore. MWD equipment often includes one or more sensors that detect an environmental condition or position and relay that information back to the driller at the surface. This information can be relayed to the surface using acoustic signals that carry encoded data about the measured condition.

Prior art systems for emitting these acoustic signals make use of wave generators that create rapid changes in the pressure of the drilling mud. The rapid changes in pressure create pulses that are carried through the drilling mud to receivers located at or near the surface. Prior art pressure pulse generators, or "mud sirens," include a single stator, a single rotor and a motor for controllably spinning the rotor. The selective rotation of the rotor temporarily restricts and releases the flow of mud through the mud siren. By controlling the rotation of the rotor, the mud siren can create a pattern of pressure pulses that can be interpreted and decoded at the surface.

Although generally effective, prior art mud sirens may experience bandwidth limitations and signal degradation over long distances due to weakness of the pressure pulses. Accordingly, there is a need for an improved mud siren that produces a stronger pressure pulse that will travel farther and carry additional data. It is to this and other deficiencies in the prior art that the present invention is directed.

SUMMARY OF THE INVENTION

The present invention includes a measurement while drilling (MWD) tool that includes a sensor, an encoder operably connected to the sensor and a modulator operably connected to the encoder. The modulator includes a first stator, a rotor and a second stator.

In another aspect, the present invention includes a modulator for use with a drilling tool encoder. The modulator includes a first stator, a rotor and a second stator. The rotor is positioned between the first stator and the second stator.

In yet another aspect, the present invention includes a drilling system adapted for use in drilling a subterranean well. The drilling system includes a drill string, a drill bit and a measurement while drilling (MWD) tool positioned between the drill string and the drill bit. The measurement while drilling tool includes a sensor, an encoder operably connected to the sensor and a modulator operably connected to the encoder. The modulator includes a first stator, a rotor and a second stator.

WRITTEN DESCRIPTION

Figure 1:
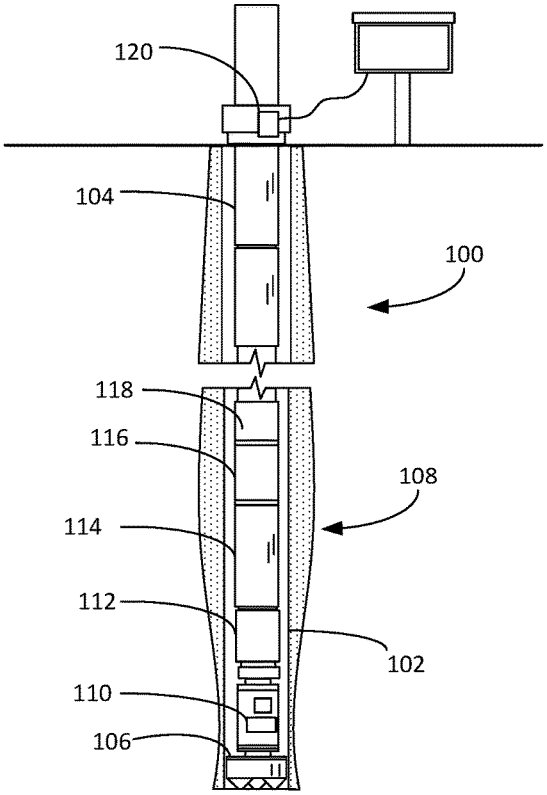
FIG. 1 is a depiction of a drilling system constructed in accordance with an embodiment of the present invention.

In accordance with an embodiment of the present invention, FIG. 1 shows a drilling system 100 in a wellbore 102. The drilling system 100 includes a drill string 104, a drill bit 106 and a MWD (measurement while drilling) tool 108. It will be appreciated that the drilling system 100 will include additional components, including drilling rigs, mud pumps and other surface-based facilities and downhole equipment.

The MWD tool 108 may include one or more sensors 110, an encoder module 112, a generator 114, a modulator 116, a motor module 118 and a receiver 120. The sensors 110 are configured to measure a condition on the drilling system 100 or in the wellbore 102 and produce a representative signal for the measurement. Such measurements may include, for example, temperature, pressure, vibration, torque, inclination, magnetic direction and position. The signals from the sensors 110 are encoded by the encoder module 112 into command signals delivered to the motor module 118.

Based on the command signals from the encoder module 112, the motor module 118 selectively rotates the modulator 116 by varying the open area in the modulator 116 through which pressurized drilling fluid may pass. The rapid variation in the size of the flow path through the modulator 116 increases and decreases the pressure of drilling mud flowing through the MWD tool 108. The variation in pressure creates acoustic pulses that include the encoded signals from the sensors 110. The pressure pulses are transmitted through the wellbore 102 to the receiver 120 and processed by surface facilities to present the driller or operator with information about the drilling system 100 and wellbore 102.

The sensors 110, encoder module 112 and motor module 118 of the MWD tool 108 can be operated using electricity. The electricity can be provided through an umbilical from the source, from an onboard battery pack or through the operation of the generator 114. The generator 114 includes a fluid-driven motor and an electrical generator. The fluid driven motor can be a positive displacement motor or turbine motor that converts a portion of the energy in the pressurized drilling fluid into rotational motion. The rotational motion is used to turn a generator that produces electrical current. It will be appreciated that some combination of batteries, generators and umbilicals can be used to provide power to the MWD tool 108.

Figure 2:
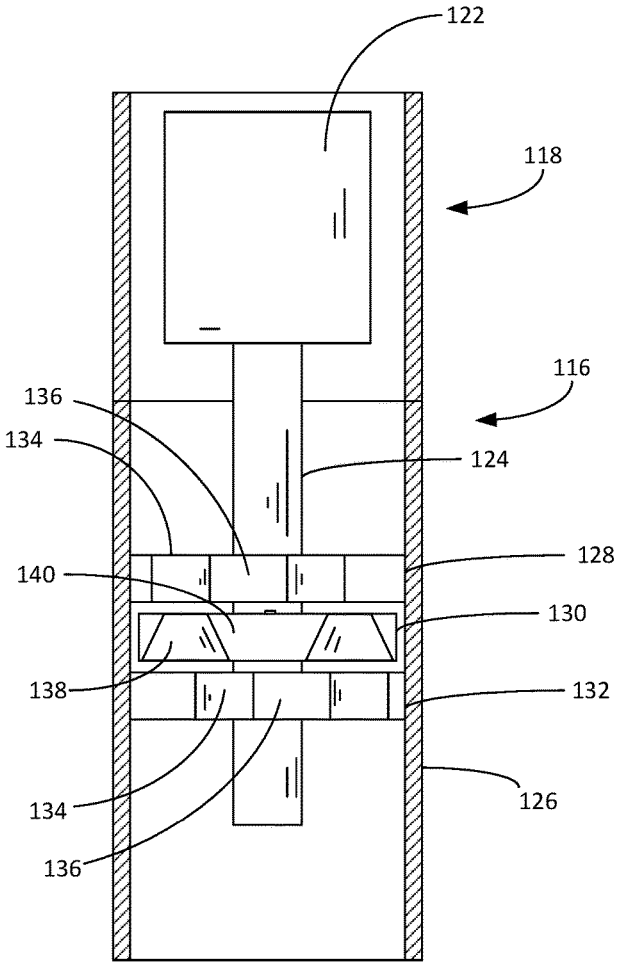
FIG. 2 is a cross-sectional view of an embodiment of the modulator and motor of the drilling system of FIG. 1.

Turning to FIG. 2, shown therein is a cross-sectional depiction of the motor module 118 and modulator 116. The motor module 118 includes a motor 122 that turns a shaft 124. The motor 122 is an electric motor that is provided with current from the generator 114 or other power source. Alternatively, the motor 122 is a fluid-driven motor that includes a speed and direction controller operated by electric signals produced by the encoder module 112.

The modulator 116 includes a housing 126, a first stator 128, a rotor 130 and a second stator 132. The first and second stator 128, 132 are fixed in a stationary position within the housing 126. In contrast, the rotor 130 is secured to the shaft 124 and configured for rotation with respect to the first and second stators 128, 132. In this way, the rotor 130 is positioned between the first and second stators 128, 132. The rotor 130 can be secured to the shaft 124 through press-fit, key-and-slot or other locking mechanisms.

Figure 3:
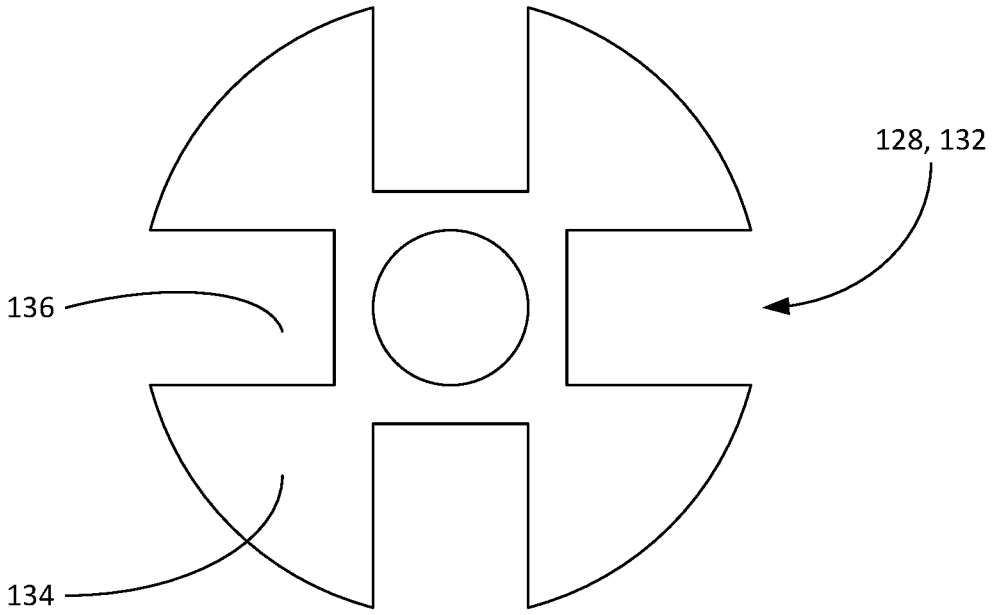
FIG. 3 is a top view of a stator of the modulator of FIG. 2.
Figure 4:
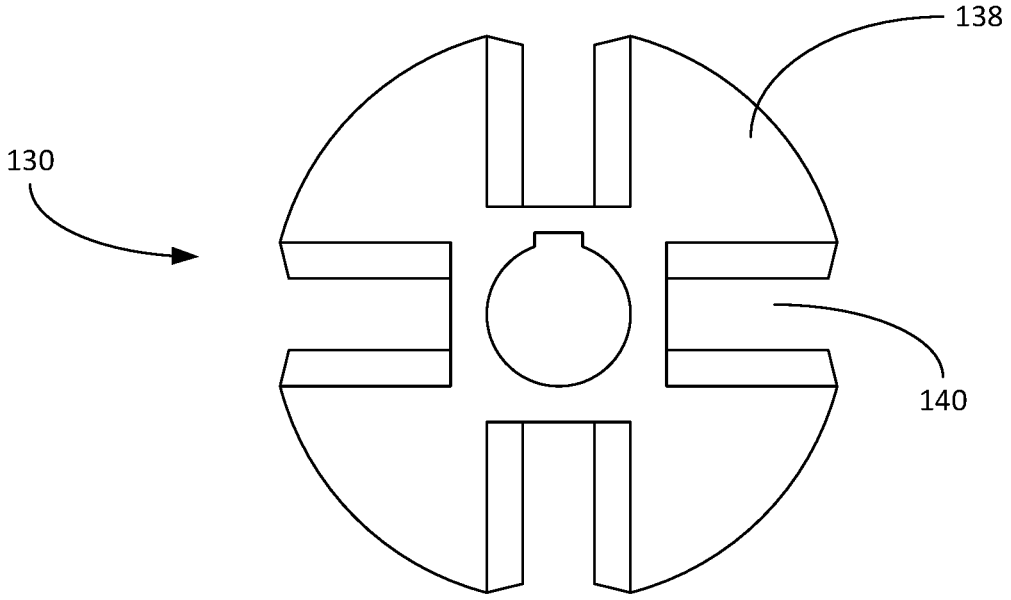
FIG. 4 is a top view of the rotor of the modulator of FIG. 2.

Referring now also to FIGS. 3 and 4, shown therein are top views of the first stator 128, rotor 130 and second stator 132. In particular, FIG. 3 provides a top view of an embodiment of the first and second stators 128, 132. FIG. 4 provides a top view of the rotor 130. The first and second stators 128, 132 each include a plurality of stator vanes 134 and stator passages 136 between the stator vanes 134. Although four stator vanes 134 and four stator passages 136 are shown, it will be appreciated that the first and second stators 128, 132 may include additional or fewer vanes and passages. It will further be appreciated that the first and second stators 128, 132 may have vanes with different geometries and configurations. In the embodiment depicted in FIG. 2, the first and second stators 128, 132 are rotationally offset within the housing 126 such that the stator vanes 134 on the first stator 128 are not aligned with the stator vanes 134 on the second stator 132.

The rotor 130 includes a series of rotor vanes 138 and rotor passages 140. The rotor vanes 138 can be pitched to promote the acceleration of fluid passing through the rotor 130. Although four rotor vanes 138 and four rotor passages 140 are shown, it will be appreciated that the rotor 130 may include additional or fewer vanes and passages.

During use, drilling fluid passes through the housing 126 and through the stator passages 136 of the first stator 128, through the rotor passages 140 of the rotor 130 and through the stator passages 136 of the second stator 132. The rotational position of the rotor 130 with respect to the first and second stators 128, 132 dictates the extent to which the velocity of the drilling fluid increases and decreases as it passes through the modulator 116. By varying the rotational position of the rotor 130, the changes in fluid velocity and the resulting changes in the pressure of the drilling fluid can be rapidly and precisely adjusted. Unlike prior art mud sirens, the use of a second stator 132 within the modulator 116 significantly increases the amplitude of the pressure pulses emanating from the modulator 116. The increased strength of the pressure pulse signals provides additional data carrying capacity and extends the distance that the pressure pulses can travel before degrading. Accordingly, the use of the second stator 132 within the modulator 116 presents a significant advancement over the prior art.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A drilling tool comprising:
- a sensor;
- an encoder operably connected to the sensor; and
- a modulator operably connected to the encoder, wherein the modulator comprises:
  - a first stator;
  - a second stator; and
  - a rotor positioned between the first stator and the second stator, wherein the rotor includes a plurality of rotor vanes and wherein each of the plurality of rotor vanes is pitched,
- wherein each of the plurality of rotor vanes is pitched to produce rotor passages that narrow across the height of the rotor.

2. The drilling tool of claim 1, further comprising a generator.

3. The drilling tool of claim 1, wherein the first stator includes a plurality of stator vanes and wherein the second stator includes a plurality of stator vanes.

4. The drilling tool of claim 3, wherein the first stator is offset in position from the second stator such that the stator vanes on the first stator are not aligned with the stator vanes on the second stator.

5. A modulator for use with a drilling tool encoder, the modulator comprising:
- a first stator;
- a second stator; and
- a single rotor positioned between the first and second stator, wherein the modulator does not include a second rotor,
- wherein the first stator includes a plurality of stator vanes and wherein the second stator includes a plurality of stator vanes, and
- wherein the first stator is offset in position from the second stator such that the stator vanes on the first stator are not aligned with the stator vanes on the second stator.

6. The modulator of claim 5, wherein the rotor includes a plurality of rotor vanes.

7. The modulator of claim 6, wherein the rotor vanes are pitched.

8. The modulator of claim 7, wherein each of the plurality of rotor vanes is pitched to produce rotor passages that narrow across the height of the rotor.

9. A drilling system adapted for use in drilling a subterranean well, the drilling system comprising:
- a drill string;
- a drill bit; and
- a measurement while drilling (MWD) tool positioned between the drill string and the drill bit, wherein the measurement while drilling tool comprises:
  - a sensor;
  - a fluid-drive power generator;
  - an encoder operably connected to the sensor;
  - a motor powered by the fluid-driven power generator, wherein the motor is controlled by the encoder;
  - a shaft driven by the motor; and
  - a modulator, wherein the modulator comprises:
    - a first stator;
    - a rotor connected to the shaft; and
    - a second stator.

10. The drilling system of claim 9, wherein the rotor is positioned between the first stator and the second stator.

11. The drilling system of claim 10, wherein the first stator includes a plurality of stator vanes and wherein the second stator includes a plurality of stator vanes.

12. The drilling system of claim 11, wherein the first stator is offset in position from the second stator such that the stator vanes on the first stator are not aligned with the stator vanes on the second stator.

13. The drilling system of claim 12, wherein the rotor includes a plurality of rotor vanes.

14. The drilling system of claim 13, wherein the rotor vanes are pitched.

15. The drilling system of claim 14, wherein each of the plurality of rotor vanes is pitched to produce rotor passages that narrow across the height of the rotor.

16. The drilling system of claim 15, wherein the modulator does not include modulator does not include a second rotor.

17. The drilling system of claim 9, wherein a distance between the rotor and the first stator is about the same as a distance between the rotor and the second stator.

* * * * *